US007316361B2

(12) United States Patent
Magel

(10) Patent No.: US 7,316,361 B2
(45) Date of Patent: Jan. 8, 2008

(54) CONTROL VALVE WITH PRESSURE COMPENSATION FOR A FUEL INJECTOR COMPRISING A PRESSURE INTENSIFIER

(75) Inventor: Hans-Christoph Magel, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 66 days.

(21) Appl. No.: 10/566,245

(22) PCT Filed: Jun. 17, 2004

(86) PCT No.: PCT/DE2004/001254

§ 371 (c)(1),
(2), (4) Date: Jan. 30, 2006

(87) PCT Pub. No.: WO2005/015000

PCT Pub. Date: Feb. 17, 2005

(65) Prior Publication Data

US 2006/0202139 A1 Sep. 14, 2006

(30) Foreign Application Priority Data

Jul. 30, 2003 (DE) ..... 103 34 771

(51) Int. Cl.
*F02M 47/02* (2006.01)

(52) U.S. Cl. ..... 239/89; 239/88; 239/91; 239/92; 239/124; 239/533.2; 239/96

(58) Field of Classification Search ..... 239/88, 239/89, 90, 91, 92, 95, 96, 533.2, 124; 251/30.01
See application file for complete search history.

(56) References Cited

U.S. PATENT DOCUMENTS

| | | | | |
|---|---|---|---|---|
| 5,163,479 | A * | 11/1992 | Keeney | 137/871 |
| 6,029,632 | A * | 2/2000 | Augustin | 123/506 |
| 6,484,697 | B2 * | 11/2002 | Boecking | 123/467 |
| 6,745,952 | B1 * | 6/2004 | Hlousek | 239/88 |
| 2003/0047619 | A1 | 3/2003 | Boecking | |
| 2003/0089802 | A1 | 5/2003 | Mahr et al. | |
| 2004/0035397 | A1 | 2/2004 | Magel | |

FOREIGN PATENT DOCUMENTS

| | | |
|---|---|---|
| DE | 100 08 268 A1 | 8/2001 |
| DE | 100 31 574 A1 | 1/2002 |
| DE | 102 18 635 A1 | 11/2002 |
| GB | 2 041 170 A | 9/1980 |

* cited by examiner

*Primary Examiner*—Dinh Q. Nguyen
(74) *Attorney, Agent, or Firm*—Ronald E. Greigg

(57) ABSTRACT

A fuel injector with a pressure booster supplied with fuel at high pressure. A work chamber of the pressure booster is separated from a differential pressure chamber via a booster piston. The pressure relief and the subjection to pressure of the differential pressure chamber are effected via a switching valve which communicates with the differential pressure chamber via a control line. A pressure chamber on an injection valve member communicates with a compression chamber of the pressure booster via a pressure chamber supply line. The switching valve is embodied as a direct-switching 3/2-way valve, whose valve needle is pressure-balanced and has both a sliding seat and a slide seal.

10 Claims, 3 Drawing Sheets

CONTROL VALVE WITH PRESSURE COMPENSATION FOR A FUEL INJECTOR COMPRISING A PRESSURE INTENSIFIER

CROSS-REFERENCE TO RELATED APPLICATIONS

This application is a 35 USC 371 application of PCT/DE 2004/00 1254 filed on Jun. 17, 2004.

BACKGROUND OF THE INVENTION

1. Field of the Invention

This invention relates to switching valves, and more particularly to an improved switching valve with pressure compensation for a fuel injector with a pressure booster.

2. Description of the Prior Art

For introducing fuel into the combustion chambers of direct-injection internal combustion engines, it is known to use stroke-controlled injection systems with a high-pressure storage chamber (common rail). The advantage of these injection systems is that the pressure of fuel injected into the combustion chamber can be adapted to the load and the rpm of the engine over wide ranges. For reducing emissions and attaining high specific performance, a high injection pressure is necessary. The attainable pressure level of high-pressure fuel pumps is limited for reasons of strength, so that for further increasing the pressure in fuel injection systems, pressure boosters in the fuel injectors are employed.

The subject of German Patent Disclosure DE 101 23 913 A1 is a fuel injection system for internal combustion engines with a fuel injector that can be supplied from a high-pressure fuel source. Between the fuel injector and the high-pressure fuel source, there is a pressure booster system that has a movable pressure booster piston. The pressure booster piston separates a chamber that can be connected to the high-pressure fuel source from a high-pressure chamber that communicates with the fuel injector. By filling a differential pressure chamber of the pressure booster system with fuel, or evacuating fuel from the differential pressure chamber, the fuel pressure in the high-pressure chamber can be varied. The fuel injector has a movable closing piston for opening and closing injection openings. The closing piston protrudes into a closing pressure chamber, so that the closing piston can be acted upon by fuel pressure in order to attain a force acting on the closing piston in the closing direction. The closing pressure chamber and the differential pressure chamber are formed by one common closing pressure differential pressure chamber, and all the partial regions of the closing pressure differential pressure chamber communicate with one another permanently for exchanging fuel. A pressure chamber for supplying fuel to the injection openings and for subjecting the closing piston to a force acting in the opening direction is provided. A high-pressure chamber communicates with the high-pressure fuel source in such a way that aside from pressure fluctuations, at least the fuel pressure of the high-pressure fuel source can prevail constantly in the high-pressure chamber; the pressure chamber and the high-pressure chamber are formed by a common injection chamber. All the partial regions of the injection chamber communicate with one another permanently for exchanging fuel.

German Patent Disclosure DE 102 294 15.1 relates to a device for damping the needle stroke in pressure-controlled fuel injectors. A device for injecting fuel into a combustion chamber of an internal combustion engine is disclosed which includes a fuel injector that can be subjected to fuel that is at high pressure via a high-pressure source. The fuel injector is actuated via a metering valve; an injection valve member is surrounded by a pressure chamber, and the injection valve member can be urged in the closing direction by a closing force. The injection valve member is assigned a damping element, which is movable independently of it and which defines a damping chamber and has at least one overflow conduit for connecting the damping chamber to a further hydraulic chamber. According to DE 102 294 15.1, the control of the fuel injector is effected with a 3/2-way valve, as a result of which an economical injector that is economical in terms of installation space can indeed be made, but this valve must control a relatively large return quantity from the pressure booster.

Instead of the embodiment of a 3/2-way valve, known from DE 102 294 15.1, servo valves may also be employed, which are embodied as leakage-free in the state of repose of the servo valve at the guide portion, which favorably affects the efficiency of a fuel injector. However, the fact that in the open state of the servo valve piston of the 3/2-way valve, no pressure face pointing in the opening direction of the valve is subjected to system pressure is a disadvantage. Moreover, a slow opening speed of the servo valve piston cannot be attained, which means that the least-quantity capability of a servo valve configured in this way is limited. In the open state of the servo valve piston, only an inadequate closing force ensues at a second valve seat embodied on it, and this can lead to leaks and increased wear.

In the servo valves known from the prior art, the major complexity in terms of production on the one hand and the attendant costs on the other are disadvantages.

SUMMARY OF THE INVENTION

With the embodiment proposed according to the invention, a direct-switching switching valve embodied as a 3/2-way valve is proposed that is completely pressure-balanced. Both a sliding seat and a slide seal are embodied on the valve needle of the switching valve. A first pressure chamber and a second pressure chamber are both embodied on the switching valve, above a low-pressure chamber. For attaining a pressure equilibrium, the diameter of the sliding seat and the diameter of the valve needle are virtually identical, so that the fuel pressure from a first pressure chamber and the fuel pressure from a second pressure chamber cannot exert any forces on the valve needle.

To avoid forces from the low-pressure chamber from acting on the valve needle, an extension may be embodied on the valve needle, on the end pointing toward the low-pressure chamber.

The sliding seat, which is located above the low-pressure chamber, can be embodied as either a flat seat or a conical seat. The actuator that actuates the direct-switching switching valve may be embodied as either a piezoelectric actuator or a magnetic actuator. For improving the metering accuracy and for metering small quantities of fuel, needle stroke damping may be provided, with which the motion of the injection valve member can be limited to extremely short distances. By means of the switching valve embodied according to the invention as a 3/2-way valve, fuel injectors that contain a pressure booster can be actuated in order to master the large return flow quantities. The embodiment according to the invention, compared to switching valves embodied as 3/2-way servo valves, offer the advantage that in terms of the production complexity they are substantially simpler to make and are thus less expensive, since only a one-piece valve needle is needed, and the hydraulic control chamber, with the tolerance-critical throttles and the requisite pilot control valve, is dispensed with. The embodiment in a one-piece valve housing assures a smaller number of parts and high precision in production between the needle guide and the needle seat. On the other hand, the valve housing may advantageously also be embodied in two parts, in conjunction with a sliding seat embodied as a flat seat. The sliding seat of the flat seat is located in a second body part embodied as a sealing plate. Because of the better accessibility for machining of the sliding seat, slide edges and valve chambers, substantially more-economical production of the valve can be achieved.

BRIEF DESCRIPTION OF THE DRAWINGS

The invention will be described in further detail below in conjunction with the drawings, in which.

DESCRIPTION OF THE PREFERRED EMBODIMENTS

Figure 1:
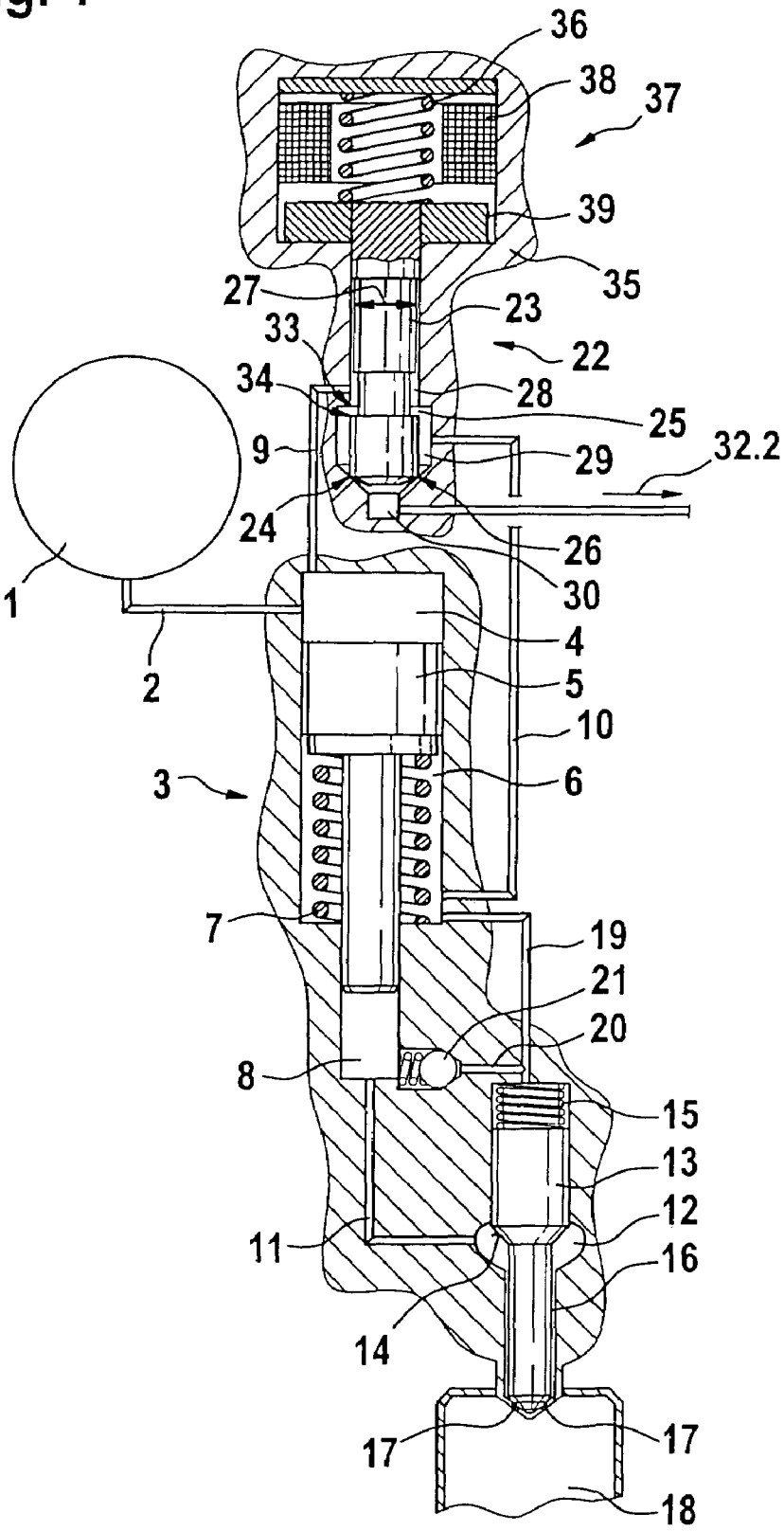
FIG. 1 is a sectional view schematically showing a fuel injector with a pressure booster, which is controlled via the differential pressure chamber and is switched via a direct-switching 3/2-way valve.

In FIG. 1, a fuel injector with a pressure booster can be seen, which is controllable via a differential pressure chamber and is actuatable by means of a direct-switching 3/2-way valve.

Via a pressure source 1, which may for example be a high-pressure reservoir (common rail) of a fuel injection system, the fuel injector communicates with a pressure booster 3 via a high-pressure supply line 2. The high-pressure supply line discharges into a work chamber 4 of the pressure booster 3. The work chamber 4 is separated via a booster piston 5 from a differential pressure chamber 6 that can be pressure-relieved and subjected to pressure. A face end of the booster piston 5 acts on a compression chamber 8 of the pressure booster 3. A restoring spring 7 is associated with the booster piston 5 of the pressure booster 3 and reinforces the restoring motion of the booster piston 5 to its position of repose. From the work chamber 4 of the pressure booster 3, an overflow line 9 extends to a switching valve 22.

The differential pressure chamber 6 of the pressure booster 3, via a control line 10, likewise communicates with the switching valve 22, which is actuatable via an actuator 37. The actuator 37 may, as indicated in FIG. 1, be embodied as a magnet valve that includes a magnet coil 38, or as a piezoelectric actuator.

From the compression chamber 8 of the pressure booster 3, a pressure chamber supply line 11 extends to a pressure chamber 12, which is embodied in the body of a fuel injector. An injection valve member 13 is received in the body of the fuel injector. The injection valve member 13, in the region of the pressure chamber 12, has a pressure shoulder 14. The injection valve member 13 is urged in the closing direction on its upper face end via a closing spring 15 that is received in a control chamber. An annular gap 16 extends from the pressure chamber 12, and by way of it, when the pressure chamber 12 is subjected to pressure, fuel flows to injection openings 17. The injection openings 17 discharge into a combustion chamber 18 of a self-igniting internal combustion engine.

The subjection of the control chamber above the injection valve member 13, which control chamber receives the closing spring 15, to pressure is effected via a connecting line 19 that connects the differential pressure chamber 6 of the pressure booster 3 with the control chamber that receives the closing spring. Branching off from the connecting line is a branch 20, in which a filling valve 21 is received which discharges into the compression chamber 8 of the pressure booster 3 and serves to refill the compression chamber upon a restoring motion of the booster piston 5.

The control line 10, leading from the differential pressure chamber 6 to the switching valve 22, discharges into a second pressure chamber 29 in the valve housing 35 of the switching valve 22. The switching valve 22 includes a valve needle 23. The valve needle 23 has a diameter 27, in its guide region inside the one-piece valve housing 35, which is equivalent to a diameter 26 at a sliding seat 24 of the valve needle 23. As a result, the one-piece valve needle 23 of the switching valve 22, embodied as a direct-switching 3/2-way valve, is pressure-balanced. Moreover, the one-piece valve needle 23 of the switching valve 22 has a slide seal 25.

By means of the slide seal 25 on the one-piece valve needle 23, the overflow line 9, discharging from the work chamber 4 into the first pressure chamber 28 of the switching valve 22, can be closed off from the second pressure chamber 29. With the sliding seat 24 closed, the second pressure chamber 29 is closed off from a low-pressure chamber 30. A low-pressure-side return 32.2 branches off from the low-pressure chamber 30 and leads to a fuel reservoir, not shown in FIG. 1.

The slide seal 25 of the one-piece valve needle 23 is formed by a control edge 33 embodied toward the housing and a control edge 34 embodied toward the valve needle, and it is located at the opposite axial end of chamber 29 from the sliding seat 24 on the low-pressure-side end of the one-piece valve needle 23.

Advantageously, the valve needle 23 is embodied in one piece and is let into a valve housing 35 that is likewise embodied in one piece. The valve needle 23 is urged in the closing direction by a closing spring 36, so that the sliding seat 24, when the actuator 37 is not actuated, always closes off the second pressure chamber 29 from the low-pressure-side return 32.2. The sliding seat 24 may be embodied as a sealing edge or as a sealing face. In the variant embodiment shown in FIG. 1, the actuator 37 is embodied as a magnetic actuator, containing a coil 38. In opposed, spaced relation to the lower annular face of the coil 38 of the magnetic actuator, the one-piece valve needle 23 has a plate 39.

In the deactivated state of repose of the pressure booster 3, the switching valve 22 is in a closed position, because of the closing spring 36 acting on the valve needle 23. In this position, shown in FIG. 1, of the one-piece valve needle 23, the differential pressure chamber 6 is in communication with the work chamber 4, via the opened slide seal 25 of the switching valve 22 and via the control line 10 and the overflow line 9. As a result, in the differential pressure chamber 6 of the pressure booster 3, the same pressure prevails as in the work chamber 4 of the pressure booster 3. By comparison, because of the closing force of the closing spring 36, the sliding seat 24 to the low-pressure chamber 30 is closed, so that the differential pressure chamber 6 is decoupled from the low-pressure-side return, and the pressure booster 3 is in its pressure-balanced state, and no pressure boosting occurs.

For the activation of the pressure booster 3, the differential pressure chamber 6 is pressure-relieved. This is done by means of triggering, that is, opening, of the switching valve 22, which can be done for instance by supplying electrical current to the magnet coil 38, causing the plate 39 on the top of the valve needle 23 to be drawn in the direction of the coil 38. As a result, the valve needle 23 moves upward. This causes the control edges 33, 34 of the slide seal 25 to overlap, closing the slide seal, while conversely the sliding seat 24 on the low-pressure-side end of the one-piece valve needle 23 opens. The result is a decoupling of the differential pressure chamber 6 from the work chamber 4, or in other words from the pressure source 1, and the differential pressure chamber 6 is pressure-relieved into the low-pressure-side return 32.2, via the control line 10 that discharges into the second pressure chamber 29 and via the open sliding seat 24. As a result, the booster piston 5 of the pressure booster 3 moves into the compression chamber 8, so that fuel under extremely high pressure moves from the compression chamber into the pressure chamber 12 via the pressure chamber supply line 11. The hydraulic force building up in the pressure chamber 12 engages the hydraulically operative face of the pressure shoulder 14 and moves the injection valve member 13, counter to the action of the closing spring 15, into an opening position, so that fuel flowing to the injection openings 17 from the pressure chamber 12 via the annular gap 16 can be injected into the combustion chamber of the engine.

For terminating the injection event, the switching valve 22 embodied as a direct-switching 3/2-way valve is activated, or in other words closed. Via the action of the closing spring 36, the one-piece valve needle 23 moves into its lower outset position. In the vertical downward motion of the one-piece valve needle 23, a closure of the sliding seat 24 and an opening of the slide seal 25, formed by the control edges 33 and 34, are effected. Via the work chamber 4, the overflow line 9, the first pressure chamber 28, the second pressure chamber 29, and the control line 10, system pressure builds up in the differential pressure chamber 6 of the pressure booster 3, as a result of which the pressure booster 3 is deactivated, or in other words, reinforced by the restoring spring 7, returns to its position of repose. The injection valve member 13 closes, since upon the pressure relief of the compression chamber 8, the pressure in the pressure chamber 12 drops as well.

Upon refilling of the differential pressure chamber 6 via the control line 10, an overflow of fuel simultaneously takes place into the connecting line 19, to the control chamber, receiving the closing spring 15, of the injection valve member 13. Via the branch 20 that branches off from the connecting line 19, fuel flows via a filling valve 21, which may for instance be embodied as a check valve, to the compression chamber 8 of the pressure booster 3 that is to be refilled.

The pressure equilibrium of the switching valve 22 embodied as a direct-switching 3/2-way valve is attained by means of matching diameters 26 in the region of the sliding seat 24 and in the region of the valve needle 23; see the needle diameter 27 in the one-piece housing 35. As a result, pressure exerted by the fuel pressure prevailing in the first pressure chamber 28 and by the fuel pressure prevailing in the second pressure chamber 29 results in no force on the one-piece valve needle 23.

Instead of the restoring spring 7, received in the differential pressure chamber 6, for reinforcing the restoring motion of the booster piston 5 into its position of repose, this spring may also be accommodated in some other chamber of the pressure booster 3, or a restoring force may be generated hydraulically.

Figure 3:
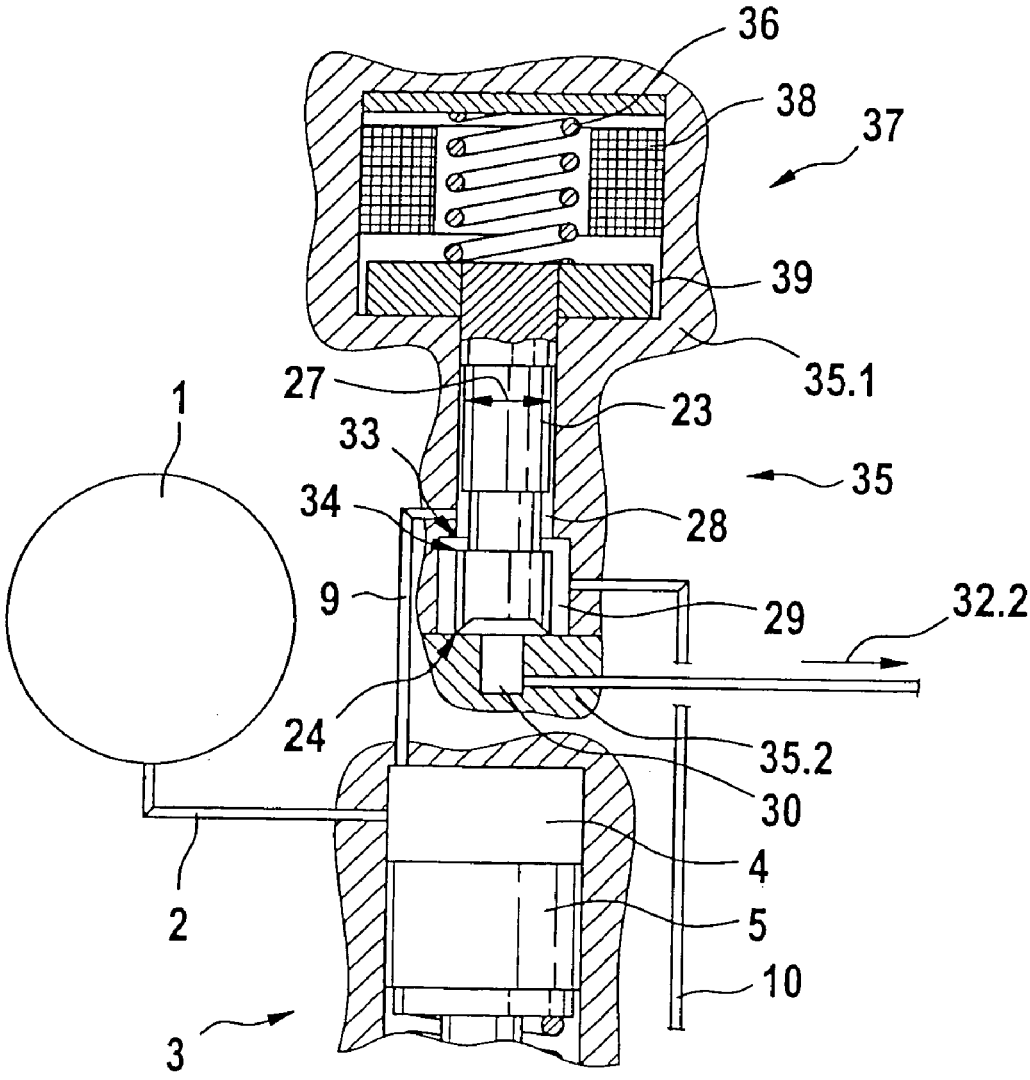
FIG. 3 is a sectional view schematically showing a valve housing in multiple parts of a direct-switching 3/2-way valve.

The sliding seat 24 may for example be embodied as a flat seat or, as indicated in FIG. 1, as a conical seat. In conjunction with a valve housing embodied in two pieces, if the sliding seat 24 is embodied as a flat seat, considerable advantages in terms of production can be attained. In a two-piece valve housing 35, the sliding seat 24 embodied as a flat seat may be located in a second valve housing part, embodied as a sealing plate 35.2 (FIG. 3). Because of the improved accessibility for machining the sliding seat 24 as well as slide edges and valve chambers, more-economical manufacture of the valve can be attained when a two-piece valve housing is used. Besides the variant embodiment of the actuator 37 as a magnet coil 38 as shown in FIG. 1, a piezoelectric actuator may be used for actuating the one-piece valve needle 23 of the direct-switching 3/2-way valve 22. For improving the metering precision and for employing small injection quantities, a damping piston can be associated with the injection valve 13; this damping piston damps the opening speed of the injection valve member 13 when the pressure booster 3 is activated and when fuel at elevated pressure is flowing from its compression chamber 8 into the pressure chamber 12.

Figure 2:
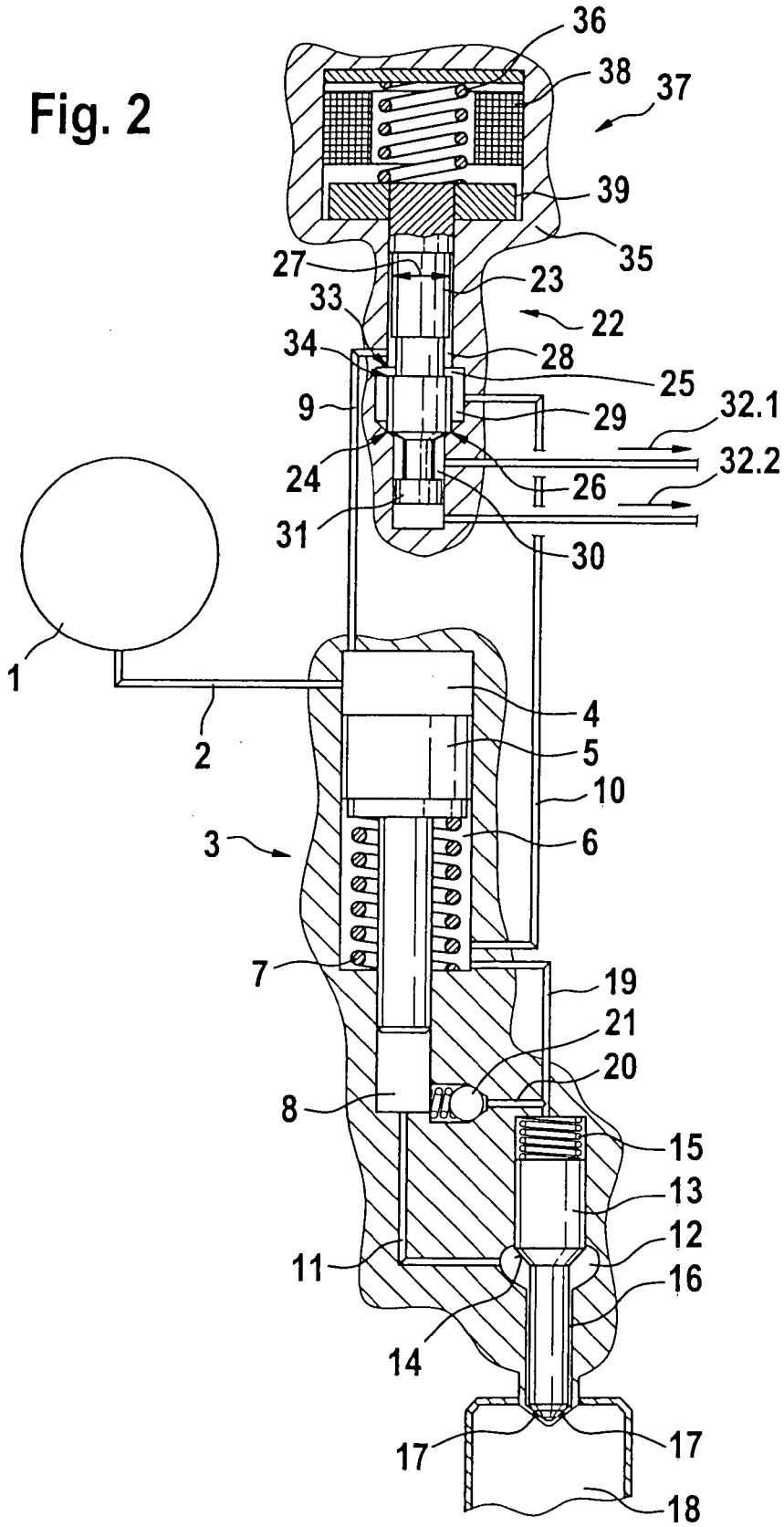
FIG. 2 is a view similar to FIG. 1. and showing a further variant embodiment of a fuel injector, whose 3/2-way switching valve has a valve needle on which an extension is embodied in the region of the low-pressure chamber of the switching valve.

FIG. 2 shows a further variant embodiment of a direct-switching 3/2-way valve, whose valve needle has an extension on the low-pressure side.

In a distinction from the variant embodiment shown in FIG. 1, there is an extension 31 on the valve needle 23 below the sliding seat 24, and it dips into the low-pressure chamber 30. Extending above the extension 31 of the one-piece valve needle 23 is a first low-pressure-side return 32.1, while a second low-pressure-side return 32.2 branches off below the extension 31. Analogously to how the one-piece valve needle 23 is shown in FIG. 1, the valve needle 23 in the variant embodiment of FIG. 2 has a slide seal 25, which is formed by a control edge 34 toward the valve needle and a control edge 33 toward the valve housing. For a pressure equilibrium of the valve needle 23, the guide diameter 27 of the valve needle 23 and the seat diameter 26 of the sliding seat 24 are equivalent to one another. With the variant embodiment shown in FIG. 2, it can be attained that pressure forces that occur in the low-pressure chamber 30 do not act on the valve needle 23. The mode of operation of the variant embodiment that is shown in FIG. 2 is equivalent to that of the fuel injector with a pressure booster 3 as shown in FIG. 1, which is actuated via the direct-switching switching valve 22, whose valve needle 23 is without the extension 31, shown in FIG. 2, in the low-pressure chamber 30.

Unlike the servo valves known from the prior art, with which a fuel injector with a pressure booster 3 can be actuated and with which the high diversion quantities upon pressure relief of the differential pressure chamber 6 of the pressure booster 3 can be mastered, the switching valve 22 is embodied as a direct-switching 3/2-way valve and because of the one-piece valve needle 23, whether this needle is embodied with or without an extension 31, the switching valve is substantially simpler and more favorable to produce, and the one-piece embodiment of the valve housing 35 of the switching valve 22, embodied as a direct-switching 3/2-way valve, assures sufficiently precise manufacture and accordingly tolerable tightness in high-pressure injection systems for direct-injection internal combustion engines.

In a two-piece valve housing 35, if a sliding seat 24 embodied as a flat seat is used, the sliding seat may be located in a valve housing part embodied as a sealing plate 35.2. This variant embodiment offers the capability of better accessibility for machining the sliding seat 24 of the slide seal 25 and the valve chambers of the valve. The variant embodiment of a direct-switching 3/2-way valve with a valve housing in more than one piece is shown in FIG. 3. The multi-piece valve housing 35 includes a first housing part 35.1, in which the valve needle 23 of the direct-switching switching valve 22 is guided. On the valve needle 23, which is embodied with a diameter 27, a plate 39 is embodied in opposition to a magnet coil 38 and is acted upon in turn by the closing spring 36. The control edge 33 toward the housing is embodied in the first housing part 35.1 and cooperates with the control edge 34 toward the valve needle. The sliding seat 24 is embodied preferably as a flat seat. By means of the sliding seat 24, the low-pressure chamber 30 is sealed off. The low-pressure chamber can be embodied, in a way that is especially simple from a production standpoint, as a blind bore, from which the low-pressure-side return 32.2 branches off. The control line 10 discharges into the second pressure chamber 29, and the overflow line 9 branching from the work chamber 4 of the pressure booster 3 discharges into the first pressure chamber 28. The second valve housing part 35.2 of the multi-piece valve housing 35 may be an independent component that is embodied separately from the injector body of a fuel injector. The second valve housing part 35.2, embodied as a sealing plate, may however be equally well formed by the injector housing itself.

The low-pressure-side returns 32.1, 32.2 shown in the variant embodiment of FIG. 2 may be united and connected to a return system that is common to both returns 32.1, 32.2.

The switching valve 22 proposed according to the invention and embodied as a direct-switching 3/2-way valve can be used in pressure boosters 3 that are controlled via a control of the pressure in the differential pressure chamber 6. Depending on the design ratio of the pressure booster 3, a pressure elevation in its compression chamber 8 is effected, which is present via the pressure chamber supply line 11 in the pressure chamber 12, which surrounds the injection valve member 13 in the region of a pressure shoulder 14. The higher the pressure prevailing there, the higher an injection pressure can be attained at the injection openings 17 that discharge into the combustion chamber 18 of the engine.

The foregoing relates to preferred exemplary embodiments of the invention, it being understood that other variants and embodiments thereof are possible within the spirit and scope of the invention, the latter being defined by the appended claims.

The invention claimed is:

1. A fuel injector comprising a pressure booster which is supplied with fuel at high pressure from a pressure source and having a work chamber separated from a differential pressure chamber via a booster piston, a switching valve which communicates with the differential pressure chamber via a control line, the switching valve being operable to effect pressure relief and subjection to pressure of the differential pressure chamber and a pressure chamber on the injection valve member in communication, via a pressure chamber supply line, with a compression chamber of the pressure booster, the switching valve being a direct-switching 3/2-way valve whose valve needle is pressure-compensated and having both a sliding seat and a slide seal, wherein the valve needle has a guide diameter in the valve housing that is substantially equivalent to a diameter of the sliding seat of the valve needle.

2. The fuel injector according to claim 1, wherein the switching valve comprises a first pressure chamber and a second pressure chamber, which can be separated from one another by the slide seal.

3. The fuel injector according to claim 1, wherein the second pressure chamber of the switching valve can be separated from a low-pressure chamber by means of the sliding seat.

4. The fuel injector according to claim 1, wherein the valve needle of the switching valve is embodied in one piece.

5. The fuel injector according to claim 1, wherein the valve needle comprises a valve needle extension which is surrounded by a low-pressure chamber.

6. The fuel injector according to claim 2, further comprising an overflow line communicating with the high-pressure source via a high-pressure supply line discharging into the first pressure chamber of the switching valve, and the control line that subjects the differential pressure chamber of the pressure booster to pressure or pressure-relieves discharges into the second pressure chamber of the switching valve, and the pressure chambers can be separated from one another or made to communicate with one another via the slide seal in accordance with the reciprocating motion of the valve needle.

7. The fuel injector according to claim 1, wherein the sliding seat is embodied as a cone seat or a flat seat on the end of the valve needle toward the low-pressure chamber.

8. The fuel injector according to claim 4, wherein the valve needle embodied in one piece is received in a valve housing embodied in one piece.

9. The fuel injector according to claim 4, wherein the valve needle embodied in one piece is received in a valve housing embodied in more than one piece.

10. The fuel injector according to claim 1, wherein the guide diameter of the valve needle is equivalent to the diameter of the slide seal.

* * * * *